United States Patent [19]

Smallegan

[11] Patent Number: 4,639,026

[45] Date of Patent: Jan. 27, 1987

[54] DOOR KNOB AND DOOR KNOB CATCH ARRANGEMENT

[75] Inventor: Jon M. Smallegan, San Mateo, Calif.

[73] Assignee: Schlage Lock Company, San Francisco, Calif.

[21] Appl. No.: 786,541

[22] Filed: Oct. 11, 1985

[51] Int. Cl.[4] ..... E05B 3/00

[52] U.S. Cl. ..... 292/352; 292/169.23; 403/11; 403/328

[58] Field of Search ..... 292/352, 244, 169.23, 292/359; 403/11, 328, 104

[56] References Cited

U.S. PATENT DOCUMENTS

| | | | |
|---|---|---|---|
| 2,801,123 | 7/1957 | Kubik | 292/352 |
| 2,842,389 | 7/1958 | Muttart | 292/352 |
| 3,091,490 | 5/1963 | Williams | 292/352 |
| 3,832,075 | 8/1974 | Arai | 403/328 |
| 4,437,695 | 3/1984 | Foshee | 292/352 |

FOREIGN PATENT DOCUMENTS

| | | | |
|---|---|---|---|
| 102191 | 7/1941 | Sweden | 403/328 |

*Primary Examiner*—Henry E. Raduazo

*Attorney, Agent, or Firm*—Walter C. Vliet; Bernard J. Murphy

[57] ABSTRACT

The arrangement comprises a standard, door knob-operated, latch mechanism in which the cylindrical shank of the door knob is slidably engaged with the rotatable spindle of the mechanism, and the spindle has a spring-biased catch projecting therethrough which passes into a slot formed in the cylindrical shank of the knob. In this way, the knob is secured on the shank. The improvement comprises forming a ramp in a cut-out on the terminal or outermost end of of the cylindrical shank, and forming a complimentary bevel on a corner of the projecting catch. Accordingly, when the knob is slidably forced onto its spindle, during manufacturing assembly, the ramp formed in the cut-out engages the bevel and, consequently, depresses the catch to allow the cylindrical shank to slide thereupon and thereover, and to allow the catch latchingly to engage the slot.

1 Claim, 3 Drawing Figures

DOOR KNOB AND DOOR KNOB CATCH ARRANGEMENT

This invention pertains to door knob-operated latching mechanisms, and in particular an improved door knob and door knob catch arrangement for such mechanisms.

As is standard practice in the prior art, the cylindrical shank of a door knob has a recess, i.e., usually a slot, formed therein to receive therewithin the uppermost portion of a spring-biased catch which protrudes from the rotatable, door-knob-receiving spindle of the mechanism. However, during manufacturing assembly it is necessary to (a) hold the body of the mechanism, (b) depress the catch against the bias of its underlying spring, and (c) push the shank of the door knob onto the spindle, sliding it over the depressed catch. This is an awkward and difficult exercise, and virtually requires three hands, or an uncommon dexterity by an assembler.

It would be greatly desirable if it were possible to push the shank of the door knob onto the spindle, and in so doing, and in some manner, coincidentally thereby depress the catch so that the cylindrical shank could slide over it to allow the catch, thereafter, to lock up into the recess (slot).

It is, therefore, an object of this invention to set forth just such an improved door knob and door knob catch arrangement.

It is also an object of this invention to set forth an improved door knob and door knob catch arrangement, for door knob-operated, latch mechanisms, including a spindle, a door knob having a cylindrical shank for a latched assembly thereof onto said spindle, and a door knob catch, resiliently projecting from said spindle, and wherein said shank has a relief formed therein for latchingly engaging said catch, the improvement comprising first and second ramp means formed on said shank, and on said catch, respectively, for accommodating a forced, slidable engagement of said first ramp means with said second ramp means, (a) to depress said catch, and (b) to allow said shank to slide over such depressed catch, whereby said catch and said relief can effect a mutual, latching engagement therebetween.

Further objects of this invention, as well as the novel features thereof, will become more apparent by reference to the following description taken in conjunction with the accompanying figures in which.

Figure 1:
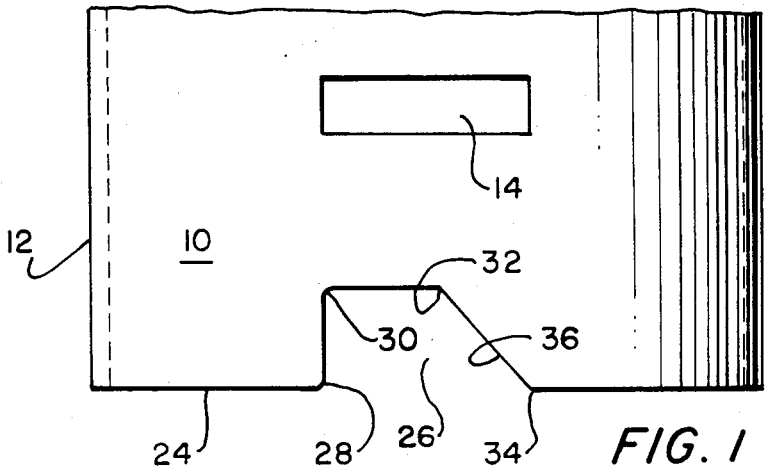
FIG. 1 is a plan view of a portion of the cylindrical shank of a door knob, the shank being modified in accordance with an embodiment of the invention which constitutes the best mode thereof known to the inventor.
Figure 2:
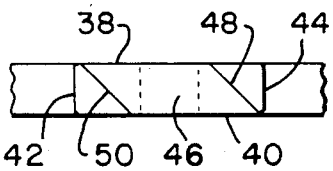
FIG. 2 is a top view of the associated door knob catch, the same also being modified pursuant to the aforesaid embodiment.

As shown in the figures, the cylindrical shank 10 of a door knob 12 has a rectangular slot 14 formed therein in which to receive the uppermost portion 16 of a catch 18 which is spring-biased and supported, retractably, within a spindle 20. A projecting portion 22 of the catch is biased by a spring (not shown) to protrude through the spindle 20 in order to engage the slot 14. On assembly, it will be evident that the catch 18 must be depressed, against the bias of the spring, in order that the cylindrical shank 10 of the door knob 12 can pass thereover to bring the slot 14 into alignment with the catch 18.

According to the invention, the leading or terminal edge 24 of the cylindrical shank 10 of the door knob 12 has a cut-out 26 formed therein. The cut-out 26 is defined by two, complementary, substantially right-angular corners 28 and 30, and two, complementary, obtuse corners 32 and 34. The latter two form a diagonal surface 36 which serves as a ramp for engaging the door knob catch 18. The door knob catch has a parallel faces 38 and 40 joined by lateral, vertical edges 42 and 44, and a topmost projecting surface 46. End corners of the catch 18 are beveled; one corner having its bevel 48 cut into one face 38 of the catch 18, and the bevel 50 on the diagonally opposite corner is cut into the other face 40. For any given assembly of a knob and a spindle, only one bevel is necessary. As can be seen, it is only one bevel which engages the ramp surface 36 of the shank 10 of the door knob 12. However, the two bevels 48 and 50 are formed on opposite corners of the catch 18 so that, during manufacturing assembly, the catch 18 may be turned either way for assembly; it need not have a given face 38 or 40 particularly oriented.

Figure 3:
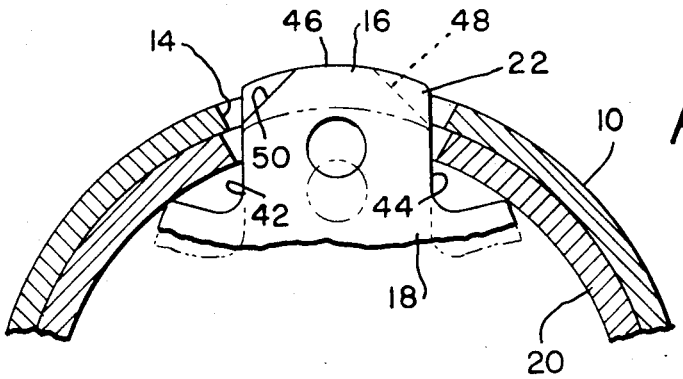
FIG. 3 is a cross-sectional view of a portion only of the embodiment of FIGS. 1 and 2, the same showing, in combination, a modified door knob catch, a spindle, and the cylindrical shank of a door knob latched by the engagement of the modified catch in the relief (slot).

On assembly, then, when the cylindrical shank 10 of the door knob 12 is forced along the spindle 20 and against the catch 18, the ramp surface 36 of the cut-out 26 rides upon the bevel 48 or 50 of the engaging corner of the catch 18 and causes the catch to depress and retract within the spindle 20, as shown in phantom in FIG. 3. Accordingly, the shank 10 may then pass over the catch 18 until the slot 14 is aligned therewith, whereupon the catch 18 rises and latchingly engages the slot 14. The knob, 12, has a projection which engages a slot in spindle 20 which provides alignment of the notch and knob catch.

While I have described my invention in connection with a specific embodiment thereof, it is to be clearly understood that this is done only by way of example and not as a limitation to the scope of my invention as set forth in the objects thereof and in the appended claims.

I claim:

1. An improved door knob and door knob catch arrangement, for door knob-operated, latch mechanisms, including a spindle, a door knob having a cylindrical shank for a latched assembly thereof onto said spindle, and a door knob catch, resiliently projecting form said spindle, and wherein said shank has a relief formed therein for latchingly engaging said catch, the improvement comprising:

first and second ramp means formed on said shank, and on said catch, respectively, for accommodating a forced, slidable engagement of said first ramp means with said second ramp means, (a) to depress said catch, and (b) to allow said shank to slide over such depressed catch, whereby said catch and said relief can effect a mutual, latching engagement therebetween;

said catch having an uppermost projecting surface, relative to said spindle;

said second ramp means comprising a given ramp formed in said surface;

said catch having a pair of parallel faces joined through a pair of lateral edges and said edges join said surface through end corners said second ramp means further comprising another ramp formed in said surface;

said given ramp comprises a bevel formed of one of said corners, and extending into one of said faces; and said another ramp comprises a bevel formed of the other of said corners, and extending onto the other of said faces.

* * * * *